US008993904B2

(12) United States Patent
Elick

(10) Patent No.: US 8,993,904 B2
(45) Date of Patent: Mar. 31, 2015

(54) TAP CHANGER WITH IMPROVED SWITCH CONSTRUCTION

(75) Inventor: Robert Alan Elick, Jackson, TN (US)

(73) Assignee: ABB Technology AG, Zürich (CH)

( * ) Notice: Subject to any disclaimer, the term of this patent is extended or adjusted under 35 U.S.C. 154(b) by 77 days.

(21) Appl. No.: 14/007,501

(22) PCT Filed: Mar. 22, 2012

(86) PCT No.: PCT/US2012/030111

§ 371 (c)(1),
(2), (4) Date: Sep. 25, 2013

(87) PCT Pub. No.: WO2012/134947

PCT Pub. Date: Oct. 4, 2012

(65) Prior Publication Data

US 2014/0014479 A1 Jan. 16, 2014

Related U.S. Application Data

(60) Provisional application No. 61/467,867, filed on Mar. 25, 2011.

(51) Int. Cl.

| | |
|---|---|
| ***H01H 19/12*** | (2006.01) |
| ***H01H 1/18*** | (2006.01) |
| ***H01H 9/00*** | (2006.01) |
| *H01H 1/22* | (2006.01) |

(52) U.S. Cl.

CPC ..... *H01H 19/12* (2013.01); *H01H 1/18* (2013.01); *H01H 1/226* (2013.01); *H01H 9/0016* (2013.01)

USPC ..... 200/11 TC

(58) Field of Classification Search

CPC ..... H01H 19/12; H01H 9/0016; H01H 1/226; H01H 1/18; H01H 9/0027; H01H 3/44; H01H 3/60; H01H 9/38; H01H 9/0038

USPC ..... 200/11 TC

See application file for complete search history.

(56) References Cited

U.S. PATENT DOCUMENTS

| | | | | |
|---|---|---|---|---|
| 2,785,242 | A * | 3/1957 | White | 200/18 |
| 2,903,530 | A * | 9/1959 | Wilson, Jr. | 200/414 |
| 3,155,782 | A * | 11/1964 | Wilson, Jr. | 200/11 TC |
| 5,107,200 | A | 4/1992 | Dohnal et al. | |
| 5,191,179 | A | 3/1993 | Yatchum et al. | |
| 2011/0000769 | A1 * | 1/2011 | Twibell et al. | 200/11 TC |

FOREIGN PATENT DOCUMENTS

WO 2012134947 A1 10/2012

* cited by examiner

*Primary Examiner* — Edwin A. Leon
(74) *Attorney, Agent, or Firm* — Paul R. Katterle

(57) ABSTRACT

An on-load tap changer is provided having a pair of bypass switches, each of which includes a plurality of contacts at least partially disposed in a contact carrier. The contacts are arranged in a stack and cooperate to form a groove and a mounting bore. A mounting post extends through the mounting bore such that the contacts are pivotable about the mounting post between an open and a closed position. When an actuation assembly moves the contacts to the open or closed position, the contacts move longitudinally relative to the contact carrier.

20 Claims, 16 Drawing Sheets

TAP CHANGER WITH IMPROVED SWITCH CONSTRUCTION

BACKGROUND OF THE INVENTION

This invention relates to tap changers and more particularly to switches for load tap changers.

As is well known, a transformer converts electricity at one voltage to electricity at another voltage, either of higher or lower value. A transformer achieves this voltage conversion using a primary winding and a secondary winding, each of which are wound on a ferromagnetic core and comprise a number of turns of an electrical conductor. The primary winding is connected to a source of voltage and the secondary winding is connected to a load. By changing the ratio of secondary turns to primary turns, the ratio of output to input voltage can be changed, thereby controlling or regulating the output voltage of the transformer. This ratio can be changed by effectively changing the number of turns in the primary winding and/or the number of turns in the secondary winding. This is accomplished by making connections between different connection points or "taps" within the winding(s). A device that can make such selective connections to the taps is referred to as a "tap changer".

Generally, there are two types of tap changers: on-load tap changers and de-energized or "off-load" tap changers. An off-load tap changer uses a circuit breaker to isolate a transformer from a voltage source and then switches from one tap to another. An on-load tap changer (or simply "load tap changer") switches the connection between taps while the transformer is connected to the voltage source. A load tap changer may include, for each phase winding, a selector switch assembly, a bypass switch assembly and a vacuum interrupter assembly. The selector switch assembly makes connections to taps of the transformer, while the bypass switch assembly connects the taps, through two branch circuits, to a main power circuit. The present invention is directed to an on-load tap changer having a bypass switch assembly with an improved switch construction.

SUMMARY OF THE INVENTION

In accordance with the present invention, an on-load tap changer is provided having a bypass switch assembly that includes a pair of bypass switches. Each bypass switch includes a fixed contact and a movable contact assembly having a contact carrier. A plurality of contacts is at least partially disposed in the contact carrier. Each of the contacts has a first end portion with a notch and a second end portion with a mounting opening extending therethrough. The mounting opening is defined by an interior surface of the contact. The interior surface includes a flat portion and an arcuate portion. The contacts are arranged in a stack such that the notches align to form a groove and the mounting openings align to form a mounting bore. A mounting post extends through the mounting bore such that the contacts are pivotable about the mounting post. An actuation assembly is connected to the bypass switches and is operable to pivot each bypass switch between a closed position, wherein the fixed contact engages the contacts and extends through the groove, and an open position, wherein the fixed contact does not contact the contacts. In each bypass switch, the flat portions of the contacts move over the mounting post during the pivoting between the open and closed positions, thereby causing the contacts to move longitudinally relative to the contact carrier.

BRIEF DESCRIPTION OF THE DRAWINGS

The features, aspects, and advantages of the present invention will become better understood with regard to the following description, appended claims, and accompanying drawings where:

DETAILED DESCRIPTION OF ILLUSTRATIVE EMBODIMENTS

Figure 1:
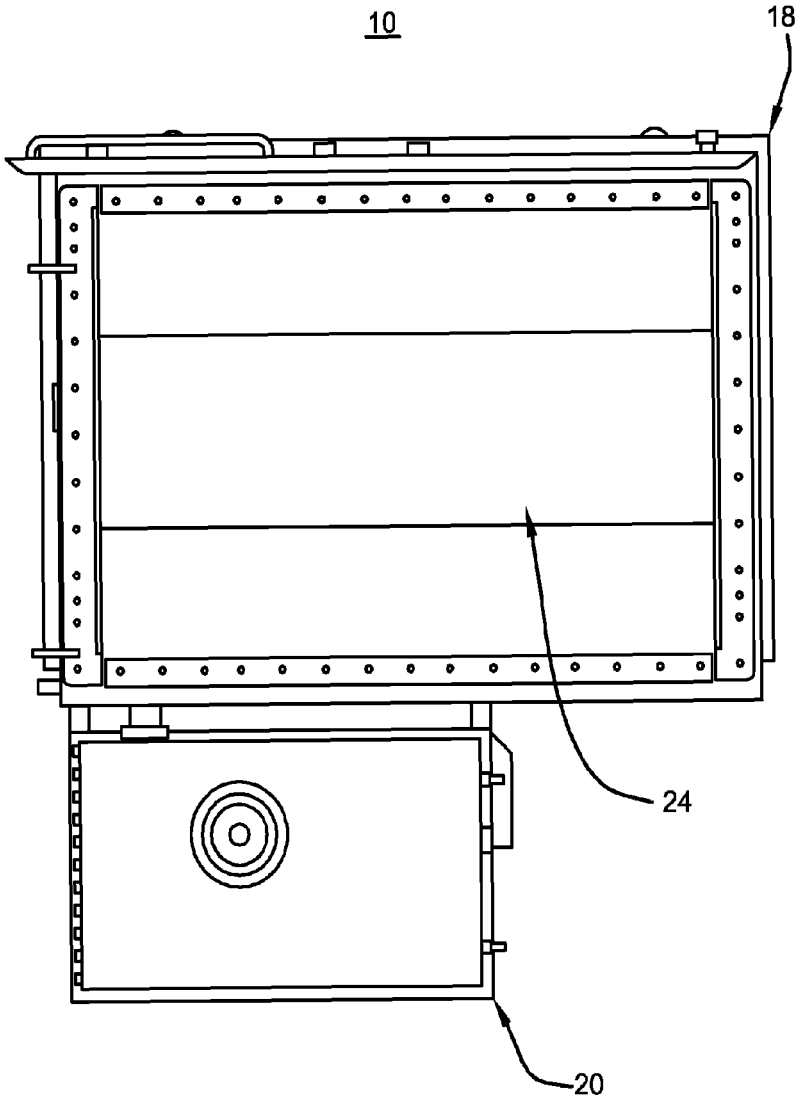
FIG. 1 shows a front elevational view of a tap changer of the present invention.

It should be noted that in the detailed description that follows, identical components have the same reference numerals, regardless of whether they are shown in different embodiments of the present invention. It should also be noted that in order to clearly and concisely disclose the present invention, the drawings may not necessarily be to scale and certain features of the invention may be shown in somewhat schematic form.

Figure 2:
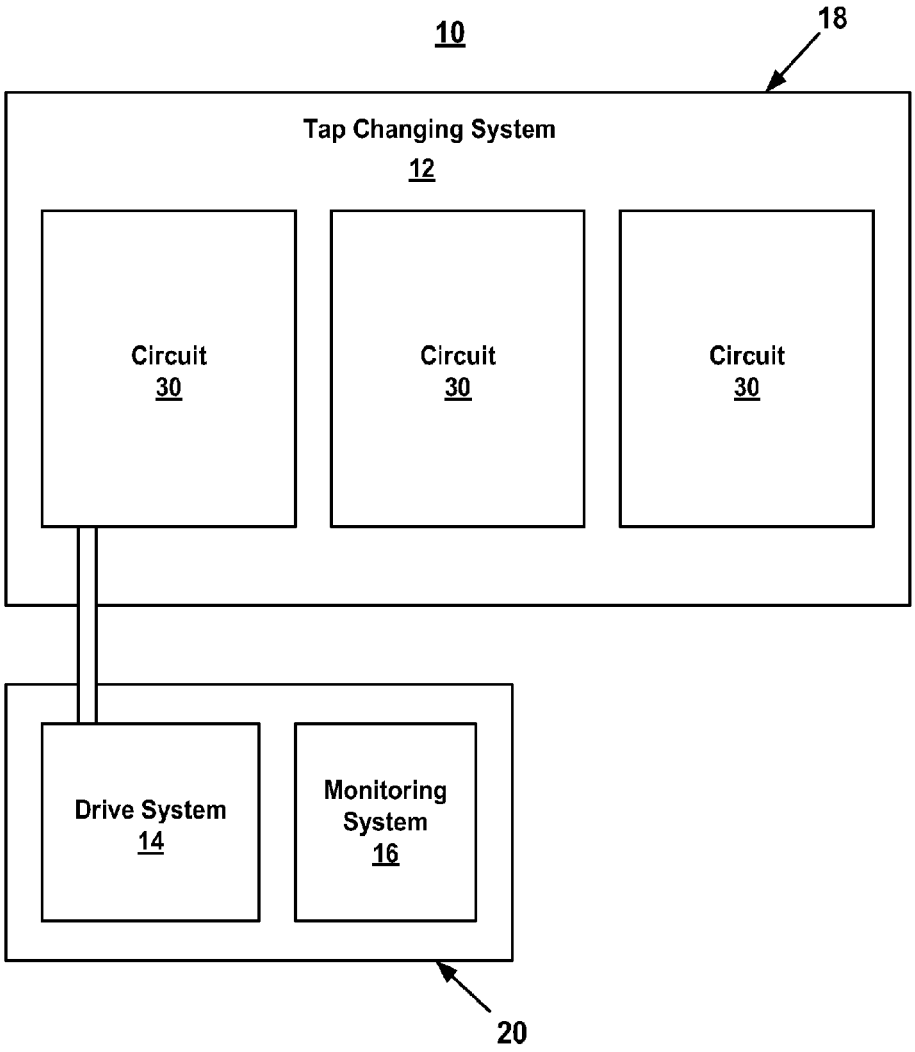
FIG. 2 shows a schematic view of the tap changer.

Referring now to FIGS. 1 and 2, there is shown a load tap changer (LTC) 10 embodied in accordance with the present invention. The LTC 10 is adapted for on-tank mounting to a transformer. Generally, the LTC 10 comprises a tap changing assembly 12, a drive system 14 and a monitoring system 16. The tap changing assembly 12 is enclosed in a tank 18, while the drive system 14 and the monitoring system 16 are enclosed in a housing 20, which may be mounted below the tank 18. The tank 18 defines an inner chamber within which the tap changing assembly 12 is mounted. The inner chamber holds a volume of dielectric fluid sufficient to immerse the tap changing assembly 12. Access to the tap changing assembly 12 is provided through a door 24, which is pivotable between open and closed positions.

Figure 3A:
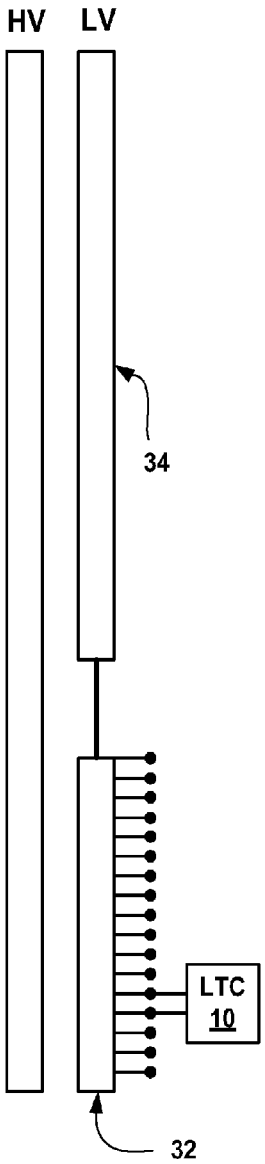
FIG. 3 shows circuit diagrams of the tap changer in linear, plus-minus and coarse-fine configurations.
Figure 3B:
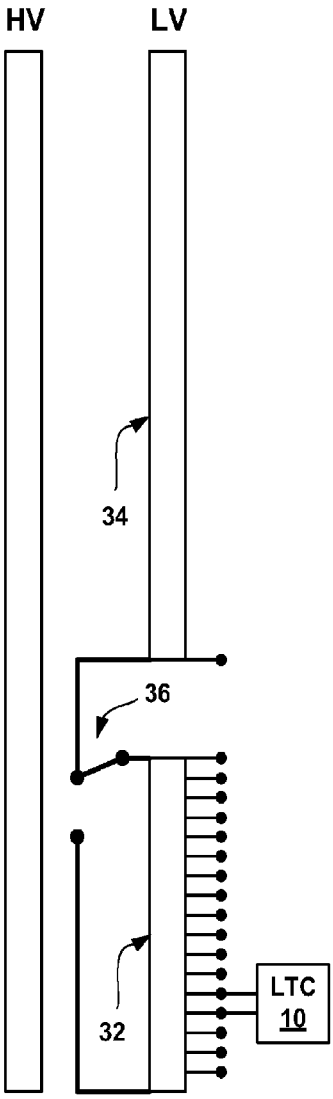
Figure 3C:
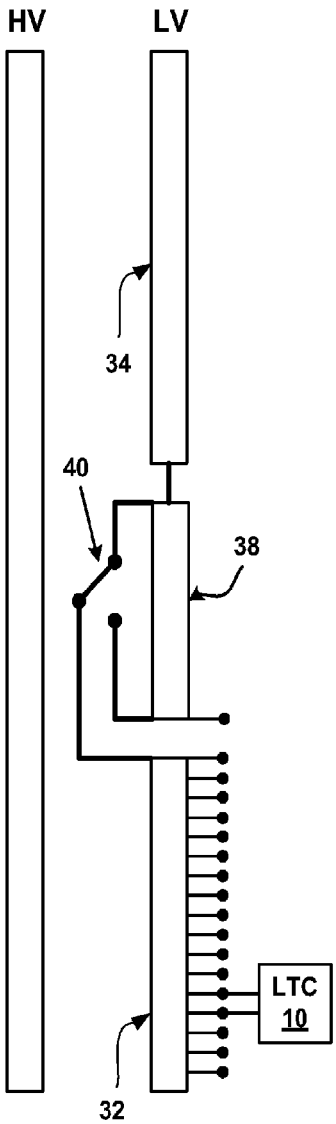

The tap changing assembly 12 includes three circuits 30, each of which is operable to change taps on a regulating winding 32 for one phase of the transformer. Each circuit 30 may be utilized in a linear configuration, a plus-minus configuration or a coarse-fine configuration, as shown in FIGS. 3*a*, 3*b*, 3*c*, respectively. In the linear configuration, the voltage across the regulating winding 32 is added to the voltage across a main (low voltage) winding 34. In the plus-minus configuration, the regulating winding 32 is connected to the main winding 34 by a change-over switch 36, which permits the voltage across the regulating winding 32 to be added or subtracted from the voltage across the main winding 34. In the coarse-fine configuration, there is a coarse regulating winding 38 in addition to the (fine) regulating winding 32. A change-over switch 40 connects the (fine) regulating winding 32 to the main winding 34, either directly, or in series, with the coarse regulating winding 38.

Figure 4:
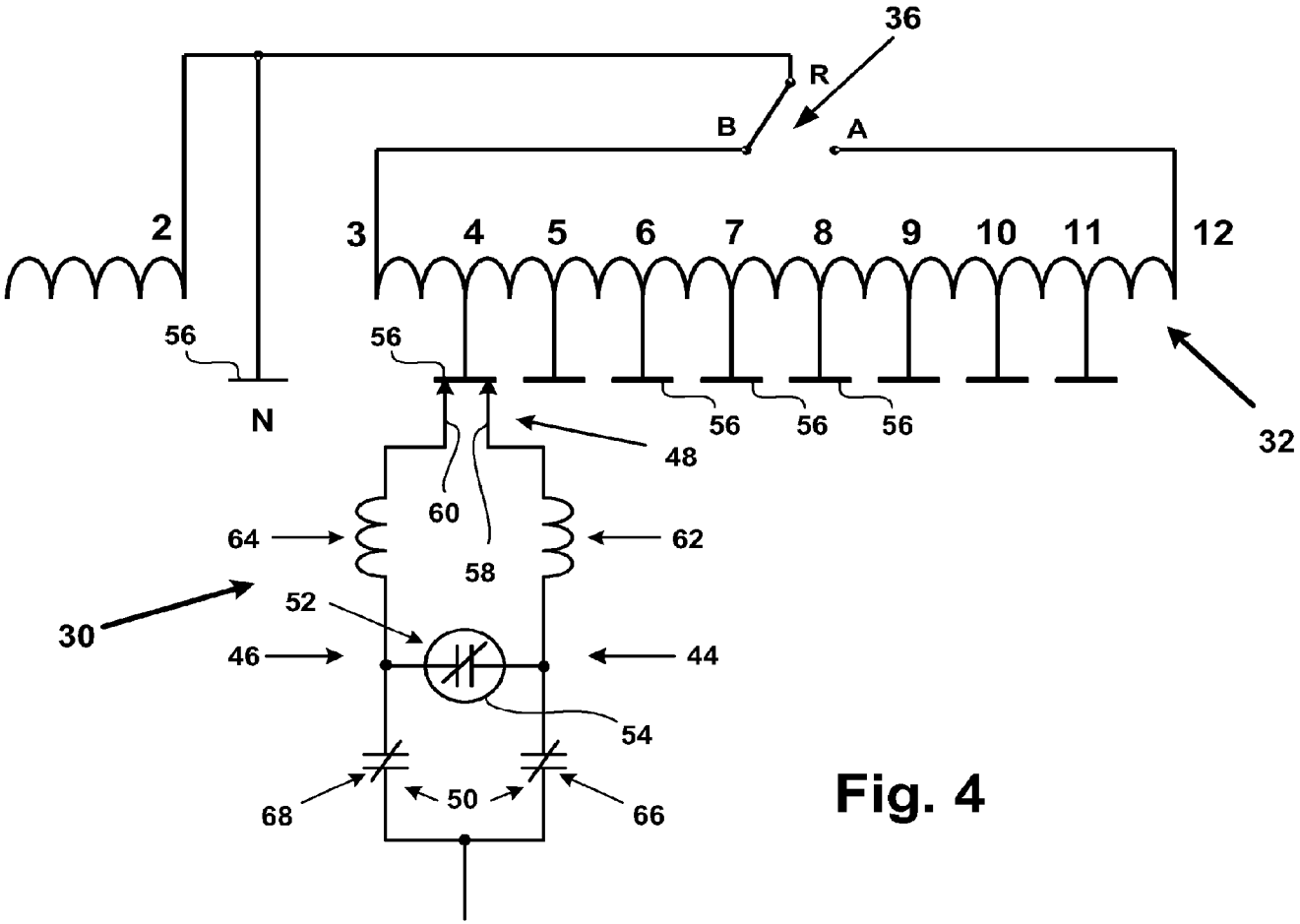
FIG. 4 shows a schematic drawing of an electrical circuit of the tap changer.

Referring now to FIG. 4, there is shown a schematic drawing of one of the electrical circuits 30 of the tap changing assembly 12 connected to the regulating winding 32 in a plus-minus configuration. The electrical circuit 30 is arranged into first and second branch circuits 44, 46 and generally includes a selector switch assembly 48, a bypass switch assembly 50 and a vacuum interrupter assembly 52 comprising a vacuum interrupter 54.

Figure 10:
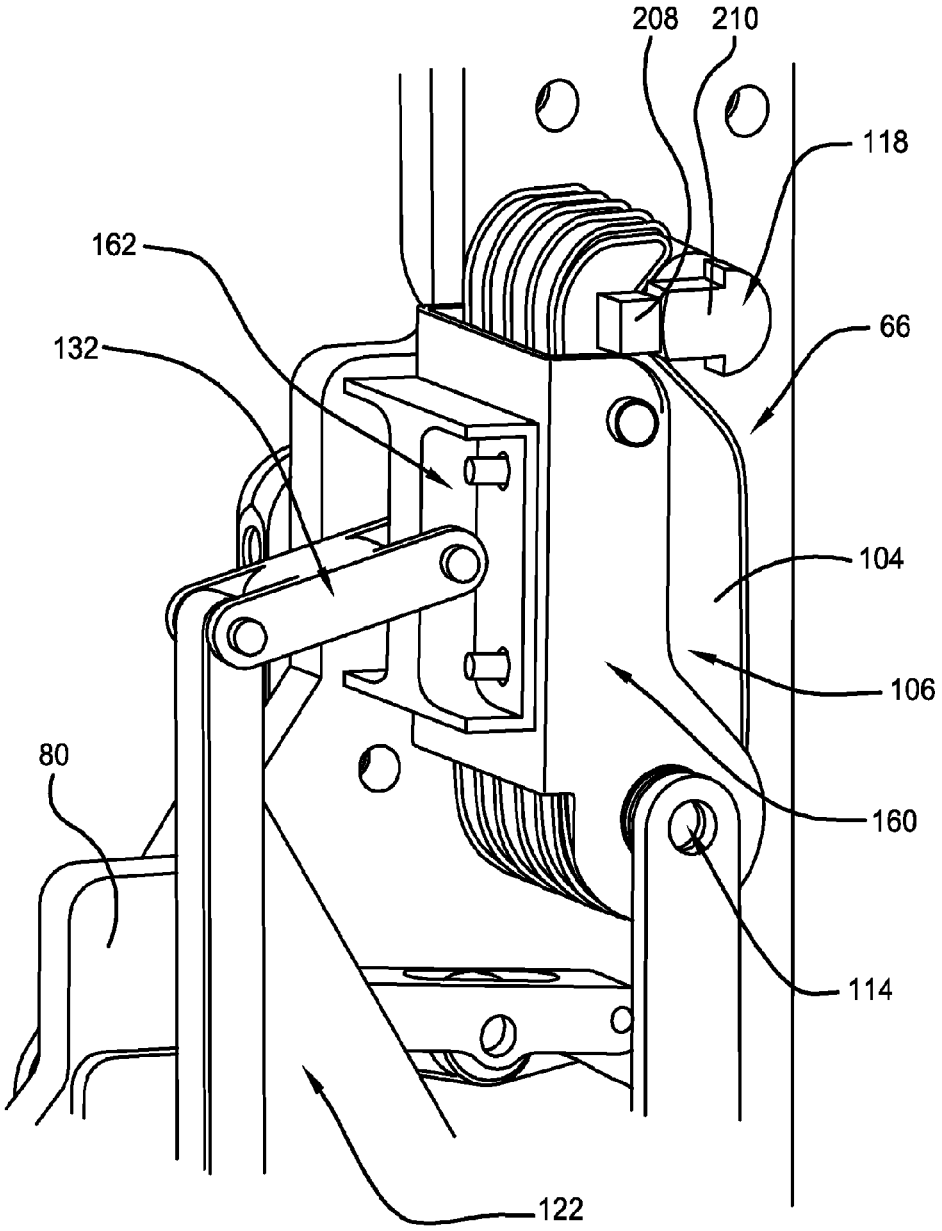
FIG. 10 shows a perspective view of a bypass switch.

The selector switch assembly 48 comprises movable first and second contact arms 58, 60 and a plurality of stationary contacts 56 which are connected to the taps of the winding 32, respectively. The first and second contact arms 58, 60 are connected to reactors 62, 64, respectively, which reduce the amplitude of the circulating current when the selector switch assembly 48 is bridging two taps. The first contact arm 58 is located in the first branch circuit 44 and the second contact arm 60 is located in the second branch circuit 46. The bypass switch assembly 50 comprises first and second bypass switches 66, 68, with the first bypass switch 66 being located in the first branch circuit 44 and the second bypass switch 68 being located in the second branch circuit 46. Each of the first and second bypass switches 66, 68 is connected between its associated reactor and the main power circuit. The vacuum interrupter 54 is connected between the first and second branch circuits 44, 46 and comprises a fixed contact 164 and a movable contact 166 enclosed in a bottle or housing 168 having a vacuum therein, as is best shown in FIG. 10.

The first and second contact arms 58, 60 of the selector switch assembly 48 can be positioned in a non-bridging position or a bridging position. In a non-bridging position, the first and second contact arms 58, 60 are connected to a single one of a plurality of taps on the winding 32 of the transformer. In a bridging position, the first contact arm 58 is connected to one of the taps and the second contact 60 is connected to another, adjacent one of the taps.

In FIG. 4, the first and second contact arms 58, 60 are both connected to tap 4 of the winding 32, i.e., the first and second contact arms 58, 60 are in a non-bridging position. In a steady state condition, the contacts 164, 166 of the vacuum interrupter 54 are closed and the contacts in each of the first and second bypass switches 66, 68 are closed. The load current flows through the first and second contact arms 58, 60 and the first and second bypass switches 66, 68. Substantially no current flows through the vacuum interrupter 54 and there is no circulating current in the reactor circuit.

Figure 5C:
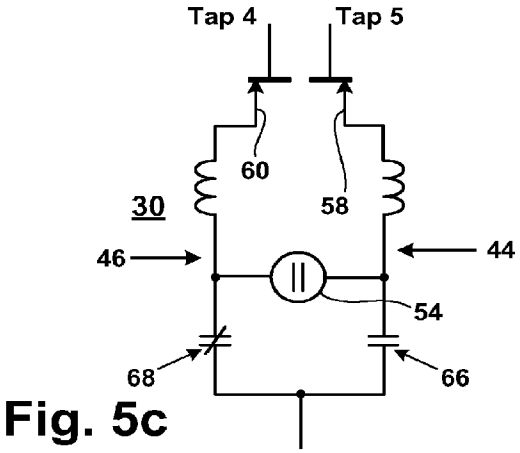
FIG. 5 shows the electrical circuit progressing through a tap change.
Figure 5B:
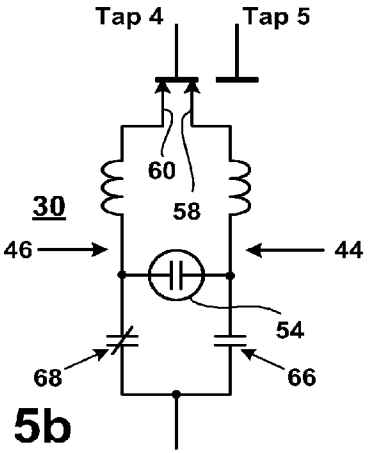
Figure 5A:
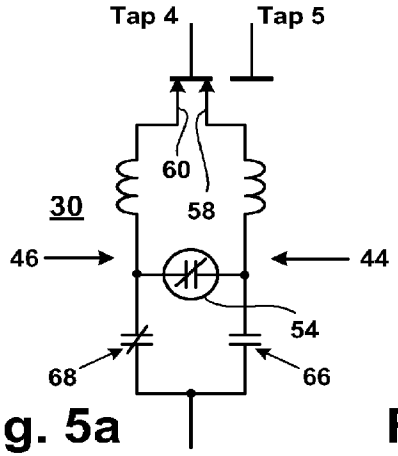
Figure 5E:
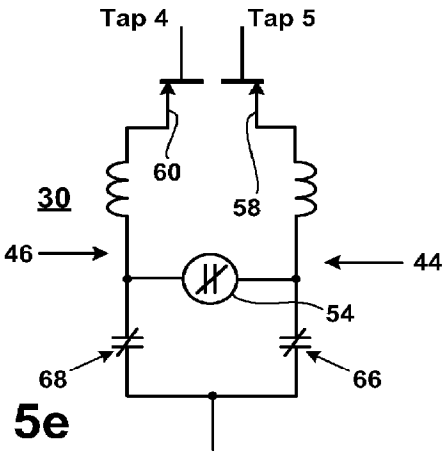
Figure 5D:
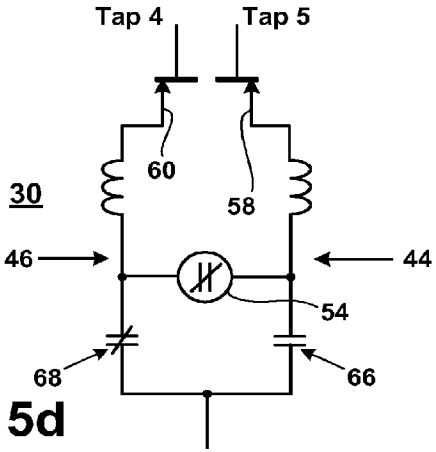

A tap change in which the first and second contact arms 58, 60 are moved to a bridging position will now be described with reference to FIGS. 5*a*-5*e*. The first bypass switch 66 is first opened (as shown in FIG. 5*a*), which causes current to flow through the vacuum interrupter 54 from the first contact arm 58 and the reactor 62. The vacuum interrupter 54 is then opened to isolate the first branch circuit 44 (as shown in FIG. 5*b*). This allows the first contact arm 58 to next be moved to tap 5 without arcing (as shown in FIG. 5*c*). After this move, the vacuum interrupter 54 is first closed (as shown in FIG. 5*d*) and then the first bypass switch 66 is closed (as shown in FIG. 5*e*). This completes the tap change. At this point, the first contact arm 58 is connected to tap 5 and the second contact arm 60 is connected to tap 4, i.e., the first and second contact arms 58, 60 are in a bridging position. In a steady state condition, the contacts 164, 166 of the vacuum interrupter 54 are closed and the contacts in each of the first and second bypass switches 66, 68 are closed. The reactors 62, 64 are now connected in series and the voltage at their midpoint is one half of the voltage per tap selection. Circulating current now flows in the reactor circuit.

Another tap change may be made to move the second contact arm 60 to tap 5 so that the first and second contact arms 58, 60 are on the same tap (tap 5), i.e., to be in a non-bridging position. To do so, the above-described routine is performed for the second branch circuit 46, i.e, the second bypass switch 68 is first opened, then the vacuum interrupter 54 is opened, the second contact arm 60 is moved to tap 5, the vacuum interrupter 54 is first closed and then the second bypass switch 68 is closed.

In the tap changes described above, current flows continuously during the tap changes, while the first and second contact arms 58, 60 are moved in the absence of current.

As best shown in FIG. 4, the selector switch assembly 48 may have eight stationary contacts 56 connected to eight taps on the winding 32 and one stationary contact 56 connected to a neutral (mid-range) tap of the winding 32. Thus, with the change-over switch 36 on the B terminal (as shown), the selector switch assembly 48 is movable among a neutral position and sixteen discreet raise (plus) positions (i.e., eight non-bridging positions and eight bridging positions). With the change-over switch 36 on the A terminal, the selector switch assembly 48 is movable among a neutral position and sixteen discreet lower (minus) positions (i.e., eight non-bridging positions and eight bridging positions). Accordingly, the selector switch assembly 48 is movable among a total of 33 positions (one neutral position, 16 raise (R) positions and 16 lower (L) positions).

Figure 6:
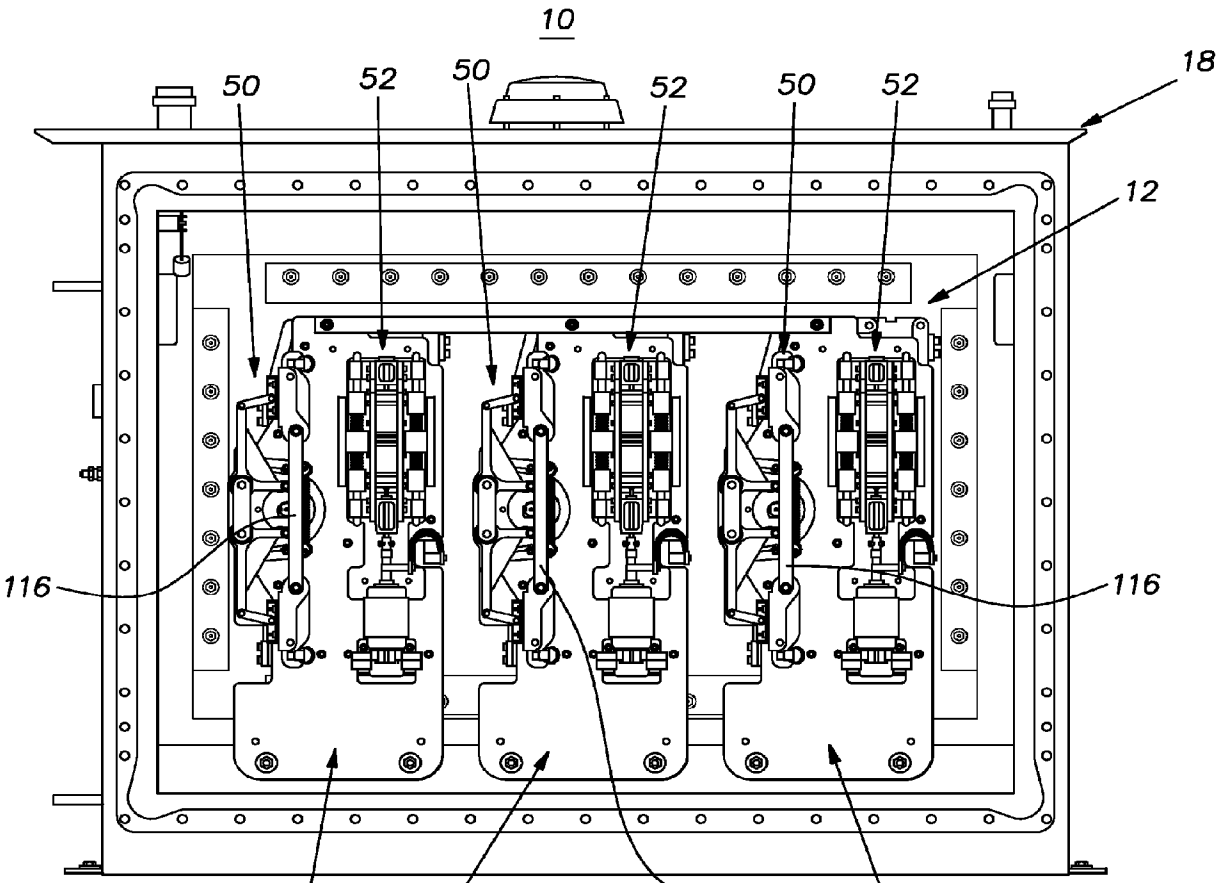
FIG. 6 shows a front view of the interior of a tank of the tap changer.

Referring now to FIG. 6, three support structures 80 are mounted inside the tank 18, one for each electrical circuit 30. The support structures 80 are composed of a rigid, dielectric material, such as fiber-reinforced dielectric plastic. For each electrical circuit 30, the bypass switch assembly 50 and the vacuum interrupter assembly 52 are mounted on a first (or front) side of a support structure 80, while the selector switch assembly 48 is mounted behind the support structure 80.

Figure 7:
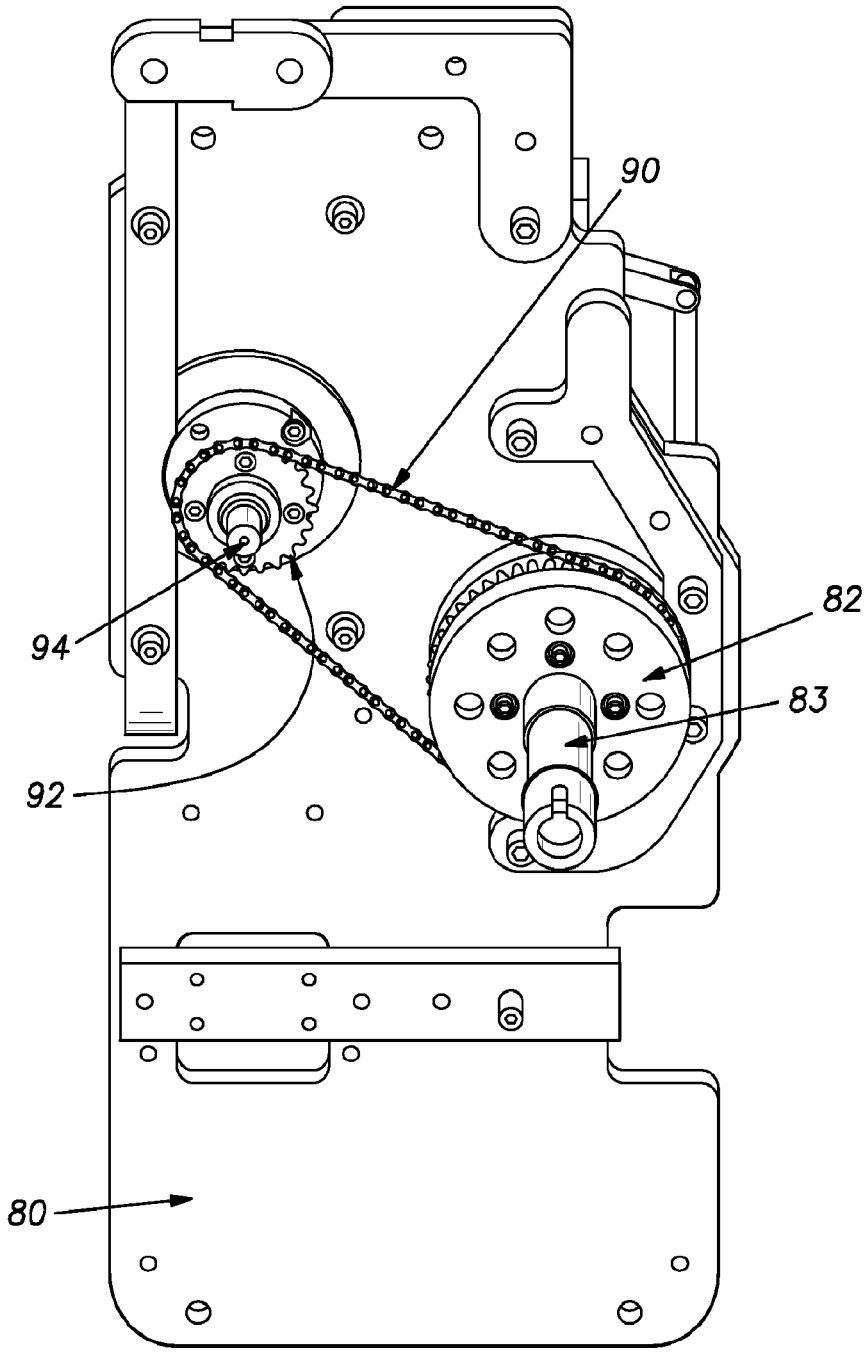
FIG. 7 shows a rear view of a front support structure of the tap changer.

Referring now to FIG. 7, the bypass switch assembly 50 includes a bypass gear 82 connected by an insulated shaft 83 to a transmission system, which, in turn, is connected to an electric motor. The bypass gear 82 is fixed to a bypass shaft that extends through the support structure 80 and into the first side of the support structure 80. The bypass gear 82 is connected by a chain 90 to a vacuum interrupter (VI) gear 92 secured on a VI shaft 94. The VI shaft 94 also extends through the support structure 80 and into the first side of the support structure 80. When the motor is activated to effect a tap change, the transmission system and the shaft 83 convey the rotation of a shaft of the motor to the bypass gear 82, thereby causing the bypass gear 82 and the bypass shaft to rotate. The rotation of the bypass gear 82, in turn, is conveyed by the chain 90 to the VI gear 92, which causes the VI gear 92 and the VI shaft 94 to rotate.

On the first side of the support structure 80, the bypass shaft is secured to a bypass cam 100, while the VI shaft 94 is secured to a VI cam 102. The bypass cam 100 rotates with the rotation of the bypass shaft and the VI cam 102 rotates with the rotation of the VI shaft 94. As will be described in more detail below, the bypass and VI gears 82, 92 are sized and arranged to rotate the bypass cam 100 through 180 degrees for each tap change and to rotate the VI cam 102 through 360 degrees for each tap change.

Figure 8:
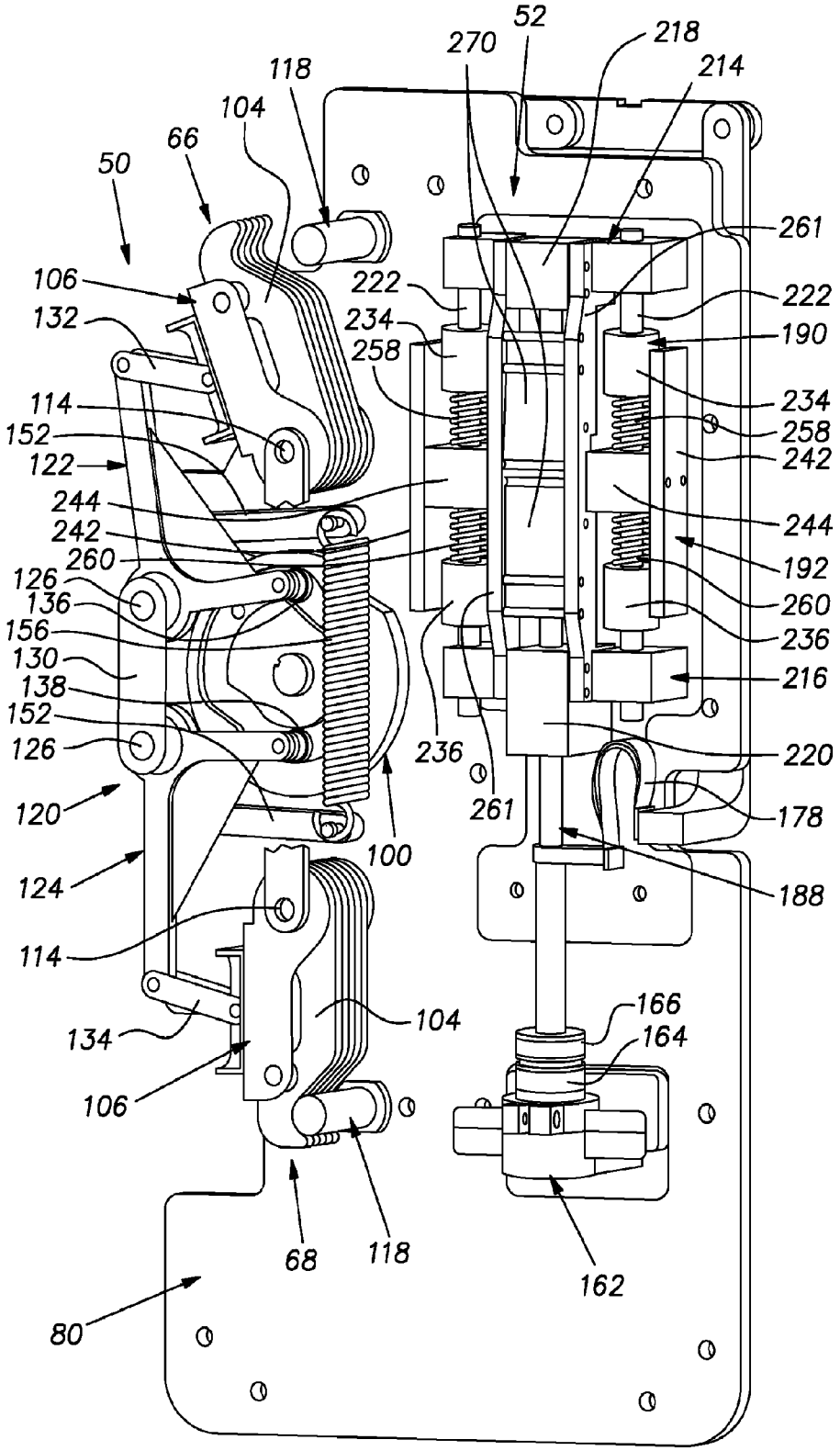
FIG. 8 shows a front perspective view of the support structure with a bypass switch assembly and a vacuum interrupter assembly mounted thereto.

Referring now to FIG. 8, the bypass switch assembly 50 includes the first and second bypass switches 66, 68, the bypass shaft and the bypass cam 100, as described above. Each of the first and second bypass switches 66, 68 comprises a plurality of contacts 104 arranged in a stack and held in a contact carrier 106. The contacts 104 are composed of a conductive metal, such as copper. Each contact 104 has a first or inner end and a second or outer end. A tapered notch (with a gradual V-shape) is formed in each contact 104 at the outer end, while a mounting opening extends through each contact 104 at the inner end. In each of the first and second contact switches 66, 68, when the contacts 104 are arranged in a stack, the tapered notches align to form a tapered groove. In addition, the mounting openings align to form a mounting bore extending through the switch. Each of the first and second bypass switches 66, 68 is pivotally mounted to the support structure 80 by a post 114 that extends through the mounting bore in the contacts 104, as well as aligned holes in the contact carrier 106 and a major tie bar 116 that extends between the first and second bypass switches 66, 68. The major tie bar 116 has been partially removed in FIG. 8 to better show other features. The entire major tie bar 116 can be seen in FIG. 6.

Each of the first and second bypass switches 66, 68 is movable between a closed position and an open position. In the closed position, a fixed contact post 118 is disposed in the groove and is in firm contact with the contacts 104. In the open position, the fixed contact post 118 is not disposed in the groove and the contacts 104 are spaced from the fixed contact post 118. The fixed contact posts 118 are both electrically connected to the main power circuit and, more specifically, to a neutral terminal. Each of the first and second bypass switches 66, 68 is moved between the closed and open positions by an actuation assembly 120.

The actuation assembly 120 is part of the bypass switch assembly 50 and comprises first and second bell cranks 122, 124. Each of the first and second bell cranks 122, 124 has a main connection point, a linkage connection point and a follower connection point, which are arranged in the configuration of a right triangle, with the main connection point being located at the right angle vertex. The first and second bell cranks 122, 124 are pivotally connected at their main connection points to the support structure by posts 126, respectively. The posts 126 extend through openings in the first and second bell cranks 122, 124 at the main connection points and through openings in the ends of a minor tie bar 130. A first end of a pivotable first linkage 132 is connected to the linkage connection point of the first bell crank 122 and a second end of the pivotable first linkage 132 is connected to the contact carrier 106 of the first bypass switch 66. Similarly, a first end of a pivotable second linkage 134 is connected to the linkage connection point of the second bell crank 124 and a second end of the pivotable second linkage 134 is connected to the contact carrier 106 of the second bypass switch 68. A wheel-shaped first cam follower 136 is rotatably connected to the follower connection point of the first bell crank 122, while a wheel-shaped second cam follower 138 is rotatably connected to the follower connection point of the second bell crank 124.

Figure 9:
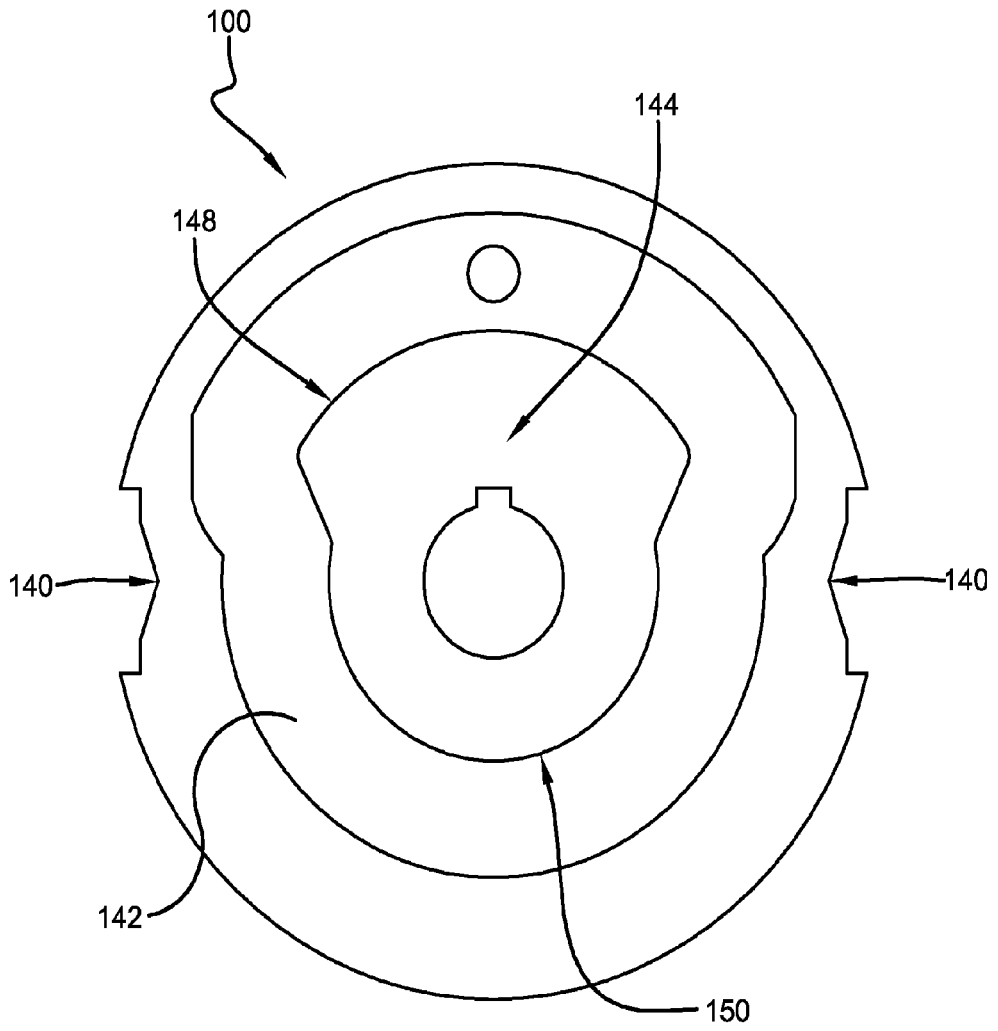
FIG. 9 shows a plan view of a bypass cam of the bypass switch assembly.

Referring now also to FIG. 9, the bypass cam 100 is generally circular and has opposing first and second major surfaces. A pair of enlarged indentations 140 may be formed in a peripheral surface of the bypass cam 100. The indentations 140 are located on opposing sides of the bypass cam 100 and have a nadir. The second major surface is flat and is disposed toward the support structure 80. The first major surface is disposed toward the door 24 (when it is closed) and has an endless, irregular groove 142 formed therein. The groove 142 is partly defined by a central area 144 having arcuate major and minor portions 148, 150. The major portion 148 has a greater radius than the minor portion 150. The transitions between the major and minor portions are tapered.

The first and second cam followers 136, 138 are disposed in the groove 142 on opposite sides of the central area 144. In a neutral or home position, the minor portion 150 of the bypass cam 100 is disposed toward the vacuum interrupter assembly 52, while the major portion 148 of the bypass cam 100 is disposed away from the vacuum interrupter assembly 52. In addition, the first and second cam followers 136, 138 are both in contact with the minor portion 150 at the junctures with the transitions to the major portion 148, respectively. With the first and second cam followers 136, 138 in these positions, both of the first and second bypass switches 66, 68 are in the closed position. When the bypass cam 100 is in the home position, the first and second contact arms 58, 60 are in a non-bridging position.

FIG. 8 shows the bypass cam 100 after it has rotated clockwise from its home, or neutral position in response to the initiation of a tap change. This rotation causes the first cam follower 136 to move (relatively speaking) through the transition and into contact with the major portion 148, while the second cam follower 138 simply travels over the minor portion 150. The movement of the first cam follower 136 through the transition increases the radius of the central area in contact with the first cam follower 136, thereby moving the first cam follower 136 outward. This outward movement, in turn, causes the first bell crank 122 to pivot counter-clockwise about the main connection point. This pivoting movement causes the first linkage 132 to pull the first bypass switch 66 outward, away from the fixed contact post 118, to the open position. As the first cam follower 136 moves over the major portion 148, the first bypass switch 66 is maintained in the open position. As the bypass cam 100 continues to rotate, the first cam follower 136 moves over the transition to the minor portion 150, thereby decreasing the radius of the central area 144 in contact with the first cam follower 136, which allows the first cam follower 136 to move inward and the first bell crank 122 to pivot clockwise. This pivoting movement causes the first linkage 132 to push the first bypass switch 66 inward, toward the fixed contact post 118, to the closed position. At this point, the tap change is complete and the bypass cam 100 has rotated 180 degrees to an intermediate position. The first and second cam followers 136, 138 are again both in contact with the minor portion 150 at the junctures with the transitions to the major portion 148, respectively, but the major portion 148 of the bypass cam 100 is now disposed toward the vacuum interrupter assembly 52, while the minor portion 150 of the bypass cam 100 is disposed away from the vacuum interrupter assembly 52. With the bypass cam 100 in this, intermediate position, both of the first and second bypass switches 66, 68 are again in the closed position. In addition, the first and second contact arms 58, 60 are in a bridging position.

If another tap change is made so that the second contact arm 60 is moved to the same tap as the first contact arm 58, i.e., a non-bridging position, the bypass cam 100 again rotates in the clock-wise direction, the second cam follower 138 moves through the transition and into contact with the major portion 148, while the first cam follower 136 simply travels over the minor portion 150. The movement of the second cam follower 138 through the transition increases the radius of the central area 144 in contact with the second cam follower 138, thereby moving the second cam follower 138 outward. This outward movement, in turn, causes the second bell crank 124 to pivot clockwise about the main connection point. This pivoting movement causes the second linkage 134 to pull the second bypass switch 68 outward, away from the fixed contact post 118, to the open position. As the second cam follower 138 moves over the major portion 148, the second bypass switch 68 is maintained in the open position. As the bypass cam 100 continues to rotate, the second cam follower 138 moves over the transition to the minor portion 150, thereby decreasing the radius of the central area 144 in contact with the second cam follower 138, which allows the second cam follower 138 to move inward and the second bell crank 124 to pivot counter-clockwise. This pivoting movement causes the second linkage 134 to push the second bypass switch 68 inward, toward the fixed contact post 118, to the closed position. At this point, the bypass cam 100 has rotated 360 degrees and the bypass cam 100 is back in the home position.

A pair of follower arms 152 may optionally be provided. The follower arms 152 are pivotally mounted to the support structure 80 and have rollers rotatably mounted to outer ends thereof, respectively. A spring 156 may be used to bias the outer ends of the follower arms 152 towards each other. This bias causes the rollers at the end of a tap change to move into the nadirs in the indentations 140. In this manner, the follower arms 152 are operable to bias the bypass cam 100 toward the home position and the intermediate position at the end of a tap change.

The first and second bypass switches 66, 68 and their operation will be described in more detail so as to highlight another feature of the present invention. It should be understood that since the first and second bypass switches 66, 68 have substantially the same construction, only the first bypass switch 66 is shown. As set forth above, in each of the first and second bypass switches 66, 68, the contacts 104 are held in a contact carrier 106 as shown in FIG. 10. The contact carrier 106 comprises a housing 160 secured to a base 162.

Figure 11:
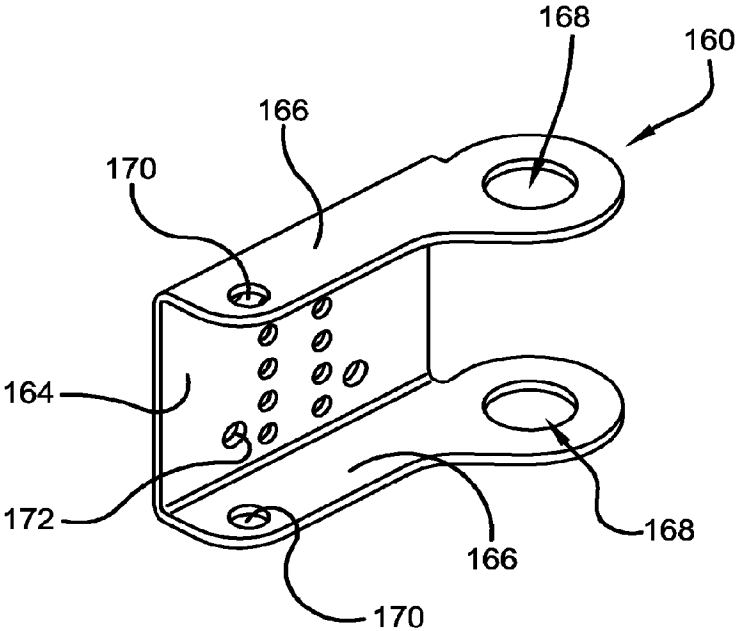
FIG. 11 shows a perspective view of a housing of the bypass switch.

As shown in FIG. 11, the housing 160 is generally channel-shaped and includes a top plate 164 joined between a pair of outward-extending side flanges 166. Mounting rings 168 are joined to inward ends of the side flanges 166, respectively. Outward ends of the side flanges 166 have holes 170 formed therein, respectively. The top plate 164 has a series of holes 172 formed therein.

Figure 12:
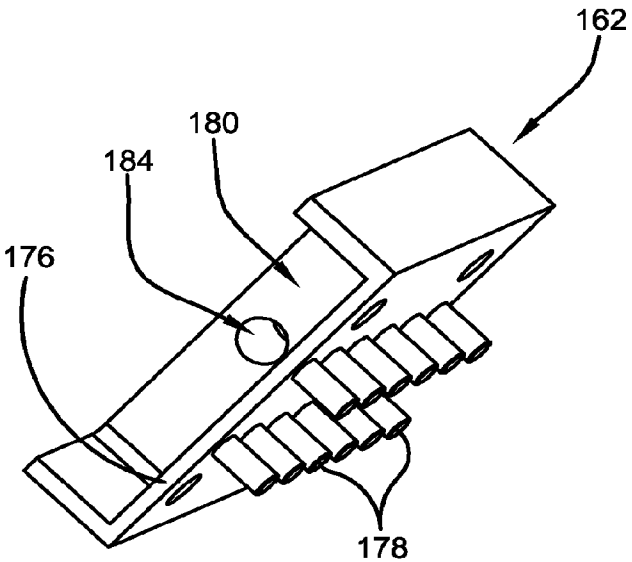
FIG. 12 shows a perspective view of a base of the bypass switch.

Referring now to FIG. 12, the base 162 includes a plate 176 with a plurality of rods 178 extending outward therefrom. The plate 176 is joined to an I-shaped beam 180. A bore 184 extends through the side of a body of the beam 180. In the first bypass switch 66, the base 162 is pivotally connected to the first linkage 132 by a pin that is journaled in the bore 184, whereas in the second bypass switch 68, the base 162 is pivotally connected to the second linkage 134 by a pin that is journaled in the bore 184.

The base 162 is secured to the housing 160 such that the rods 178 extend through the holes 172 in the top plate 164 of the housing 160. The base 162 is secured to the housing 160 by nuts and bolts or other fastening means.

Figure 13:
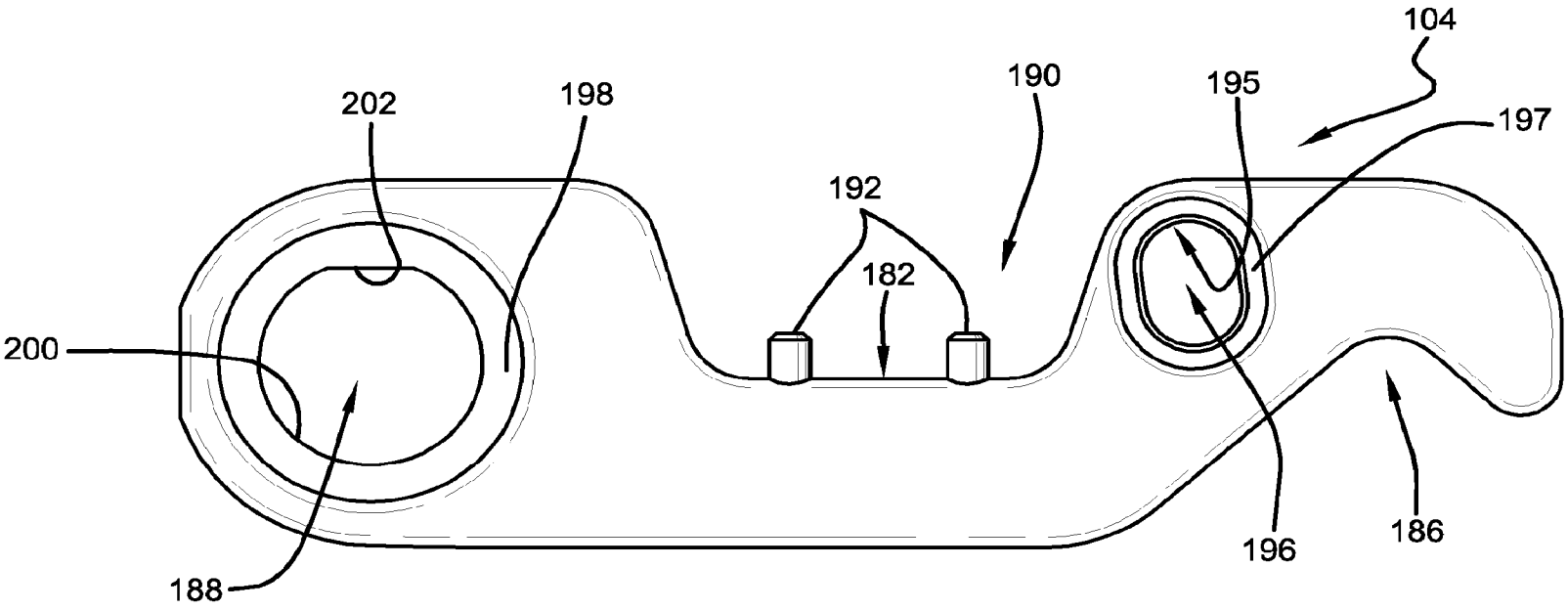
FIG. 13 shows a side view of a contact of the bypass switch.

As best shown in FIG. 13, each contact 104 has a first or inner end and a second or outer end. A tapered (gradual V-shaped) notch 186 is formed in each contact 104 at the outer end, while a mounting opening 188 extends through each contact 104 at the inner end. Between the inner and outer ends, an enlarged indentation 190 is formed in the contact 104. A pair of posts 192 extend from a bottom surface of the indentation 190. Toward the outer end, between the indentation 190 and the notch 186, an oval guide opening 196 extends through the contact 104. The surface of the contact 104 is raised around the guide opening 196 so as to form a rim 197. An internal surface 195 defines the guide opening 196.

Figure 14:
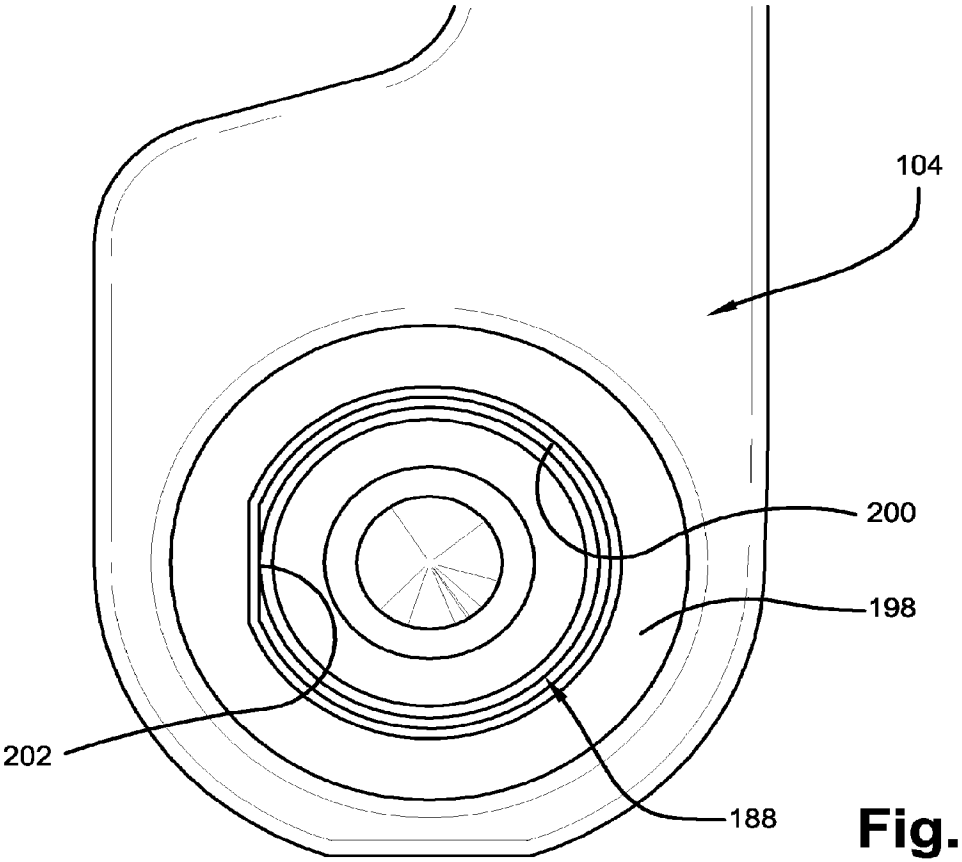
FIG. 14 shows a close-up view of an inner end of the contact having a mounting opening.

Referring now to FIG. 14, an enlarged view of the mounting opening 188 in a contact 104 is shown. The surface of the contact 104 is raised around the mounting opening 188 so as to form a rim 198. The mounting opening 188 is defined by an internal surface 200. The internal surface 200 is circular, except for a rolling surface portion 202, which is flat. As will be described below, the rolling surface portion 202 translates rotational movement of the contact 104 into longitudinal movement of the contact 104.

The number of contacts 104 in each of the first and second bypass switches 66, 68 is determined by the amount of current being conducted. In the embodiment shown in FIG. 10, there are six contacts 104 in each switch. In each switch, the contacts 104 are arranged in the contact carrier 106 in a stack, as described above. The rims 197, 198 help separate middle portions and the outer ends of the contacts 104. As described above, in each switch, the tapered notches 186 of the contacts 104 align to form a tapered groove and the mounting openings 188 align to form a mounting bore extending through the switch. In addition, in each switch, the guide openings 196 align to form a guide bore extending through the switch. In each switch, the mounting bore is aligned with the mounting rings 168 of the housing 160 of the contact carrier 106 and the guide bore is aligned with the holes 170 in the side flanges 166 of the housing 160.

Figure 15:
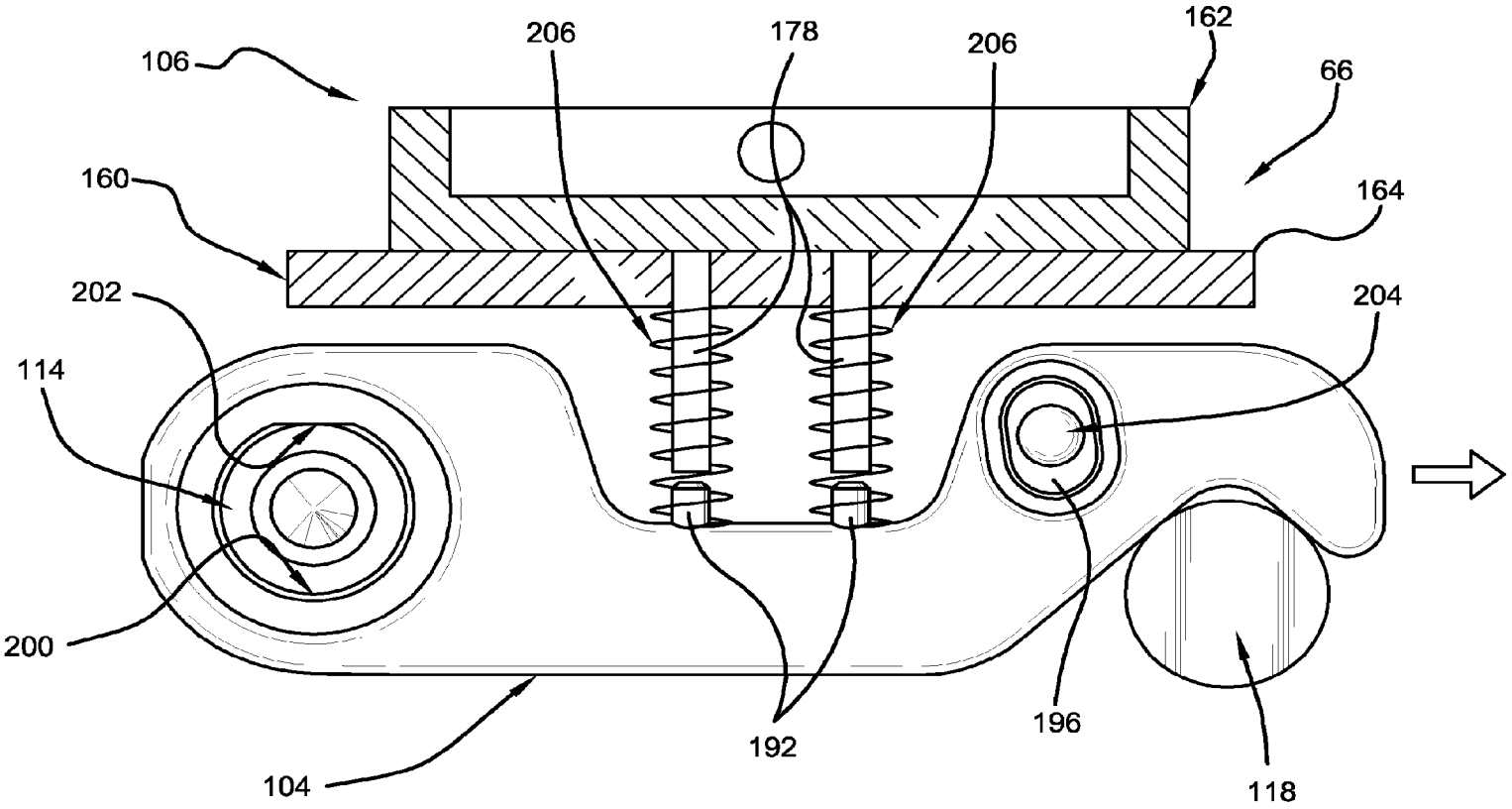
FIG. 15 shows a side sectional view of the bypass switch.

Referring now to FIG. 15, there is shown a sectional view of the first bypass switch 66. In each of the first and second bypass switches 66, 68, the post 114 extends through the mounting bore in the contacts 104 and through the mounting rings 168 of the contact carrier 106. In addition, in each switch, a guide rod 204 extends through the guide bore in the contacts 104 and through the holes 170 of the contact carrier 106. In this manner, the contacts 104 are retained in the contact carriers 106 of the first and second bypass switches 66, 68 and the first and second bypass switches 66, 68 are pivotally mounted to the support structure 80.

In each of the first and second bypass switches 66, 68, with the contacts 104 mounted in the contact carrier 106, as described above, the posts 192 of each contact 104 are aligned with rods 178 of the base 162 of the contact carrier 106. The ends of the posts 192 and the rods 178 are close together or even touching. Each aligned pair of post 192 and rod 178 extends through a helical spring 206 that is trapped between the top plate 164 of the contact carrier 106 and an inner edge 182 of the contact 104. The springs 206 bias the contacts 104 away from the contact carrier 106.

In each of the first and second bypass switches 66, 68, one of the contacts 104 (hereinafter referred to as the arcing contact 104) is provided with springs 206 that exert more force than the springs 206 for the other contacts 104. As a result, in each switch, the arcing contact 104 makes first and breaks last. This early making and late breaking causes any arcing to be confined to the arcing contact 104. Since the arcing is confined to the arcing contacts 104, the arcing contacts 104 have a more robust (arc-resistant) construction than the other contacts 104. For example, the arcing contacts 104 may be composed of tungsten or an alloy of tungsten, whereas the other contacts 104 may simply be composed of copper. The arcing contact 104 in each of the first and second bypass switches 66, 68 is the contact 104 that is farthest from the support structure 80.

As shown in FIG. 10, an arc block 208 may be fixed to an outside surface of the arcing contact 104, proximate to the notch 186, in each of the first and second bypass switches 66, 68. Corresponding arc blocks 210 may be secured to the fixed contact posts 118, respectively. The arc blocks 208, 210 are each comprised of a copper alloy, such as a copper-tungsten alloy, and help extend the lives of the arcing contacts 104 and the fixed contact posts 118. For purposes of better showing the grooves formed by the stacks of contacts 104, the arc blocks 208, 210 are not shown in FIG. 8.

The operation of the first bypass switch 66 will now be described, it being understood that the operation of the second bypass switch 68 is substantially the same, except for the direction of rotation of the switch and the bell crank. As described above, during the opening of the first bypass switch 66, the first bell crank 122 pivots counter-clockwise about the main connection point, which causes the first linkage 132 to pull the base 162 of the contact carrier 106 outward. As a result, the contacts 104 start to rotate counter-clockwise about the post 114. In each contact 104, the flat rolling surface portion 202 of the internal surface 200 moves over the post 114. This movement is translated into a longitudinal movement of the contact 104 outward in the direction of the arrow in FIG. 15. This outward movement is stopped by contact between the post 114 and a lower arcuate portion of the internal surface 200 and contact between a lower portion of the interior surface 195 and the guide rod 204. At this point, the rolling surface portion 202 starts sliding over the post 114 as the first bypass switch 66 continues to open.

Figure 16:
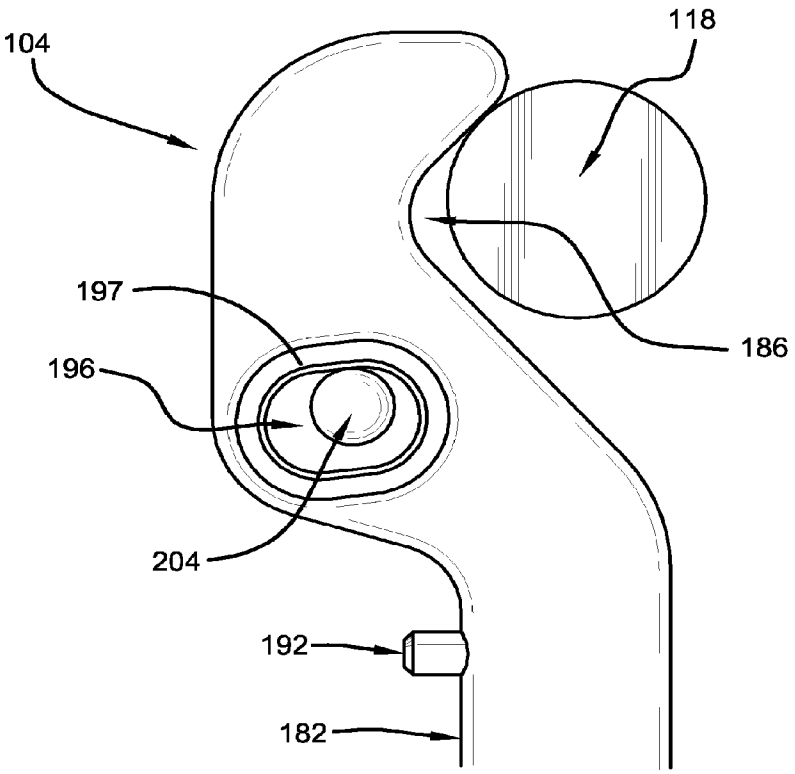
FIG. 16 shows a close-up view of an outer end of the contact initially touching a fixed contact post.
Figure 17:
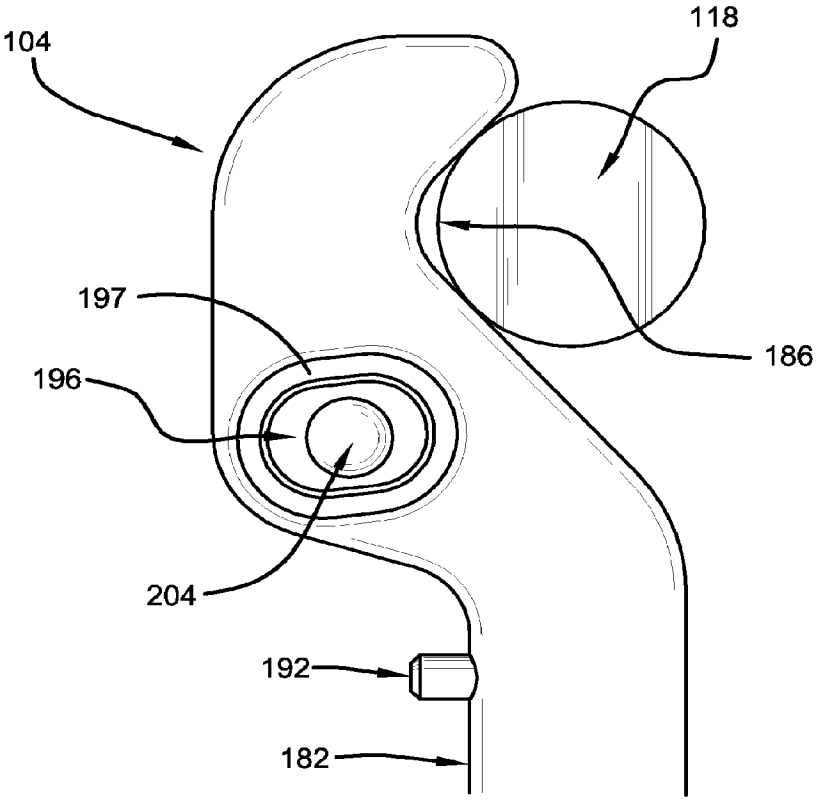
FIG. 17 shows a close-up view of the outer end of the contact centered on the fixed contact post.

During the closing of the first bypass switch 66, the first bell crank 122 pivots clockwise about the main connection point, which causes the first linkage 132 to push the base 162 of the contact carrier 106 inward. As a result, the contacts 104 start to rotate clockwise about the post 114. In each contact 104, the flat rolling surface portion 202 of the internal surface 200 moves over the post 114. This movement is translated into a longitudinal movement of the contact 104 inward. This inward movement is stopped by contact between the post 114 and an upper arcuate portion of the internal surface 200 and contact between an upper portion of the interior surface 195 and the guide rod 204. The contacts 104 initially contact the fixed contact post 118 as shown in FIG. 16. With regard to each of the contacts 104, the fixed contact post 118 is not seated or centered, i.e., the fixed contact post 118 does not contact surfaces of the contact 104 in the notch 186 on opposing sides of the nadir of the notch 186. Instead, the fixed contact post 118 only contacts a surface of the contact 104 on an outer side of the nadir. The springs 206, however, cause all of the contacts 104, except the arcing contact 104, to become centered, i.e., to slide longitudinally outward and toward the fixed contact post 118. This sliding or wiping of the contacts 104 helps keep the contacts 104 clean and free of carbon build-ups. A view of a contact 104 after being centered is shown in FIG. 17.

Due to the larger force exerted by the springs 206 associated with the arcing contact 104, the arcing contact 104 does not center on the fixed contact post 118. This larger spring force also causes the arcing contact 104 to be the last of the contacts 104 to separate from the fixed contact post 118 when the first bypass switch 66 moves toward the open position (breaks) and also causes the arcing contact 104 to be the first to contact the fixed contact post 118 when the first bypass switch 66 moves toward the closed position (makes).

Although the switch construction described above is particularly well suited for bypass switches (as embodied in the first and second bypass switches 66, 68), it should be appreciated that the switch construction may be utilized in other applications, such as in change-over (reversing) switches.

It is to be understood that the description of the foregoing exemplary embodiment(s) is (are) intended to be only illustrative, rather than exhaustive, of the present invention. Those of ordinary skill will be able to make certain additions, deletions, and/or modifications to the embodiment(s) of the disclosed subject matter without departing from the spirit of the invention or its scope, as defined by the appended claims.

What is claimed is:

1. An on-load tap changer comprising:

a bypass switch assembly comprising:

(a.) a pair of bypass switches, each bypass switch comprising:

a fixed contact;

a movable contact assembly comprising:

a contact carrier;

a plurality of contacts at least partially disposed in the contact carrier, each of the contacts having a first end portion with a notch and a second end portion with a mounting opening extending therethrough, the mounting opening being defined by an interior surface of the contact, the interior surface comprising a flat portion and an arcuate portion;

wherein the contacts are arranged in a stack such that the notches align to form a groove and the mounting openings align to form a mounting bore; and a mounting post extending through the mounting bore such that the contacts are pivotable about the mounting post; and (b.) an actuation assembly connected to the bypass switches and operable to pivot each bypass switch between a closed position, wherein the fixed contact engages the contacts and extends through the groove, and an open position, wherein the fixed contact does not contact the contacts; and wherein in each bypass switch, the flat portions of the contacts move over the mounting post during the pivoting between the open and closed positions, thereby causing the contacts to move longitudinally relative to the contact carrier.

2. The on-load tap changer of claim 1, wherein the interior surface of each contact is circular except for the flat portion.

3. The on-load tap changer of claim 1, wherein the housing is channel-shaped and includes a top plate joined between a pair of outwardly-extending side flanges.

4. The on-load tap changer of claim 2, wherein each bypass switch further comprises at least one spring for each contact, the at least one spring associated with each contact biases the contact away from the top plate of the housing.

5. The on-load tap changer of claim 4, wherein when each bypass switch moves from the closed position to the open position, the contacts move longitudinally outward, and when each bypass switch moves from the open position to the closed position, the contacts move longitudinally inward.

6. The on-load tap changer of claim 5, wherein the notch in each contact is generally V-shaped and has a nadir, and wherein for each bypass switch, when the bypass switch moves from the open position to the closed position, at least one contact initially touches the fixed contact only on a surface on the outer side of the nadir, the at least one spring associated with the at least one contact then moving the at least one contact so as to become centered on the fixed contact such that the fixed contact touches surfaces of the at least one contact on opposing sides of the nadir.

7. The on-load tap changer of claim 6, wherein in each bypass switch, the at least one contact that becomes centered on the fixed contact comprises all of the contacts except for an arcing contact.

8. The on-load tap changer of claim 7, wherein the at least one spring comprises a plurality of springs.

9. The on-load tap changer of claim 8, wherein in each bypass switch, the arcing contact has a different composition than the other contacts.

10. The on-load tap changer of claim 9, wherein the arcing contacts are composed of copper and tungsten and the other contacts are composed of copper.

11. The on-load tap changer of claim 9, wherein in each bypass switch, the arcing contact is the last of the contacts to disengage from the fixed contact when the bypass switch moves from the closed position to the open position and is the first of the contacts to engage the fixed contact when the bypass switch moves from the open position to the closed position.

12. The on-load tap changer of claim 9, wherein each of the contacts has one or more of the springs associated with it; and wherein in each bypass switch, the one or more springs associated with the arcing contact exert more force than any of the springs associated with the other contacts.

13. The on-load tap changer of claim 9, wherein the notch in each contact is generally V-shaped and has a nadir, and wherein for each bypass switch, when the bypass switch moves from the open position to the closed position, each of the contacts except the arcing contact initially touches the fixed contact only on a surface on the outer side of the nadir, the at least one spring associated with the contact then moving the contact so as to become centered on the fixed contact such that the fixed contact touches surfaces of the contact on opposing sides of the nadir.

14. The on-load tap changer of claim 9, wherein in each bypass switch, the arcing contact has a first arc block fixed to a side surface of the first end portion, proximate to the notch, and the fixed contact has a second arc block secured to an outer end thereof.

15. The on-load tap changer of claim 4, wherein the at least one spring comprises a plurality of springs and the top plate has a plurality of holes formed therein; and wherein the contact carrier further comprises a base secured to the housing and pivotally connected to the actuation assembly, the base having a plurality of outwardly-projecting posts that extend through the openings in the top plate, the posts extending through the springs.

16. The on-load tap changer of claim 13, wherein in each bypass switch, each contact has a guide opening located toward the notch, the guide openings in each bypass switch being aligned so as to form a guide bore in the bypass switch; and wherein each bypass switch further comprises a guide rod extending through the guide bore.

17. The on-load tap changer of claim 16, wherein in each bypass switch, the guide openings are elliptical and when the bypass switch moves between the open and closed positions, there is relative movement between the guide rod and the guide openings.

18. The on-load tap changer of claim 1, wherein the actuation assembly comprises:

a rotatable bypass cam having a center area that partially defines an endless groove, the center area including arcuate major and minor portions; and cam followers disposed in the endless groove of the bypass cam, the cam followers being connected to the bypass switches, respectively.

19. The on-load tap changer of claim 18, wherein each bypass switch is connected to its respective cam follower by a linkage and a bell crank.

20. The on-load tap changer of claim 19, wherein rotation of the bypass cam during a tap change causes the cam followers to move over the major and minor portions of the center area, with one of the cam followers moving over the major portion while the other of the cam followers moves over the minor portion; and wherein the movement of each cam follower over a transition from the minor portion to the major portion causes the associated bell crank to pivot and thereby move the associated bypass switch from the closed position to the open position.

* * * * *